United States Patent [19]

Tsai et al.

[11] 4,444,640

[45] Apr. 24, 1984

[54] DIMENSIONALLY STABLE ASBESTOS-POLYTETRAFLUOROETHYLENE DIAPHRAGMS FOR CHLORALKALI ELECTROLYTIC CELLS

[75] Inventors: Shan-Pu Tsai; Leo L. Benezra, both of Mentor; Lewis R. Horvat, Painesville; John P. Hazzard, Mentor, all of Ohio

[73] Assignee: Diamond Shamrock Corporation, Dallas, Tex.

[21] Appl. No.: 362,865

[22] Filed: Mar. 29, 1982

Related U.S. Application Data

[63] Continuation-in-part of Ser. No. 189,036, Sep. 22, 1980, abandoned.

[51] Int. Cl.[3] ..... C25B 11/03; C25B 13/06; C25B 13/08; B05D 5/12

[52] U.S. Cl. ..... 204/283; 204/296; 204/295; 427/58; 427/245; 427/247; 524/455; 524/546

[58] Field of Search ..... 204/283, 295, 296, 252, 204/98; 260/42.27; 427/216, 58, 245, 247; 428/394; 524/455, 546

[56] References Cited

U.S. PATENT DOCUMENTS

| | | | |
|---|---|---|---|
| 3,524,753 | 8/1970 | Sharp | 427/245 |
| 3,928,166 | 12/1975 | O'Leary et al. | 204/296 X |
| 4,031,041 | 6/1977 | Bouy et al. | 524/455 X |
| 4,065,534 | 12/1977 | Rechlicz et al. | 204/296 X |
| 4,093,533 | 6/1978 | Beaver et al. | 204/296 |
| 4,208,246 | 6/1980 | Kiga et al. | 204/295 X |
| 4,210,515 | 7/1980 | Patil et al. | 204/296 X |
| 4,255,523 | 3/1981 | Ukihashi et al. | 204/296 X |

FOREIGN PATENT DOCUMENTS

| | | | |
|---|---|---|---|
| 55-73885 | 6/1980 | Japan | 204/296 |
| 7400587 | 7/1974 | Netherlands | 204/296 |

*Primary Examiner*—Donald R. Valentine
*Attorney, Agent, or Firm*—Jennifer L. Skord; John P. Hazzard

[57] ABSTRACT

Diaphragm coated electrodes, processes for producing these diaphragm coated electrodes, and application of the diaphragm coated electrodes in electrolytic cells used in the electrolysis of brine to produce chlorine and caustic are disclosed.

8 Claims, No Drawings

DIMENSIONALLY STABLE ASBESTOS-POLYTETRAFLUOROETHYLENE DIAPHRAGMS FOR CHLORALKALI ELECTROLYTIC CELLS

RELATED U.S. APPLICATION DATA

This application is a continuation-in-part of U.S. Ser. No. 189,036 filed Sept. 22, 1980, now abandoned.

BACKGROUND OF THE INVENTION

Diaphragms for electrolytic cells used to produce chlorine, and sodium hydroxide or potassium hydroxide from brine (hereinafter generally referred to as "chlor-alkali" cells) are conventionally asbestos fiber mat structures supported directly by the cathode of the chlor-alkali cell. Such asbestos diaphragms suffer the serious disadvantage of swelling under load, sometimes, for example, swelling up to 800 percent. Such swelling can result in filling the anode diaphragm gap, thereby increasing cell voltage and subjecting the diaphragm itself to attrition by gas released at the anode surface proximate to the swollen diaphragm. The result of severe swelling of the asbestos diaphragm and of attrition caused by gas released at the anode proximate the swollen diaphragm is to limit the lifetime of such diaphragms, used commercially, to approximately six months.

Many attempts and proposals for overcoming the problems of the conventional asbestos diaphragms involve polymer modification of the asbestos sheets. However, the majority of existing diaphragm-type cells are of complex geometric design; accordingly, the composite sheets are necessarily formed exterior to the cell and cannot be employed without significantly reducing the available diaphragm surface area. Moreover, such composite sheet diaphragms must be used in the filter press or "sandwich" type cell design to be useful.

One specific suggestion, for overcoming the problems of asbestos diaphragms, involves impregnating a preformed asbestos diaphragm with monomer or polymer and subsequently polymerizing the monomer in situ, or curing the polymer. However, such impregnation of asbestos fiber diaphragms results in the formation of continuous polymer coating on the surface of the asbestos fibers; the continuous polymer coating eliminates the water permeability properties of the asbestos fibers. Moreover, impregnation techniques which, by design or by accident, form a continuous skin on one surface of the asbestos, render the asbestos impermeable to the electrolyte.

Another proposal for overcoming the disadvantages of asbestos diaphragms involves a process which includes depositing a diaphragm from a slurry of asbestos fibers and polytetrafluoroethylene fibers on a foraminous cathode and heat treating the deposit to physcially bind it and to strengthen the diaphragm. However, the cost of these die-drawn polytetrafluoroethylene fibers of relatively large diameter are excessive and exceed the cost of fibrids as described in the instant invention. Likewise, the amount of such fibers required in the diaphragm for a given level of operation exceeds the amounts required when fibrids are utilized.

SUMMARY OF THE INVENTION

The invention is directed to new and improved electrodes coated with fiber-like polytetrafluoroethylene (PTFE) modified asbestos diaphragms, to the production of these diaphragms, and to use of these diaphragms in chlor-alkali cells.

The new and improved diaphragms of the present invention include a foraminous substrate which is electrically conductive which is coated with a random mixture of asbestos fibers and polytetrafluoroethylene fibrids (described below) and which is subsequently subjected to temperatures effective to dehydrate the asbestos and/or to cause the fibrous PTFE component in the coating to shrink and form an interlocking matrix.

The new and improved diaphragm of the present invention is dimensionally stable and exhibits substantially less swelling during use than prior diaphragms. Power efficiencies of cells incorporating the new and improved diaphragm of the invention are accordingly superior to power efficiencies of conventional asbestos diaphragms when used in chlor-alkali cells. Significantly, new and improved diaphragms of the present invention exhibit substantially increased lifetimes compared to conventional diaphragms used in chlor-alkali cells.

DETAILED DESCRIPTION OF THE INVENTION

The new and improved diaphragms of the present invention are produced by depositing a random mixture of asbestos fibers and polytetrafluoroethylene fibers (i.e. fibrous material of various lengths and about 0.2 microns to about 100 microns in diameter, which are distinct and well separated and which are produced by a shearing action on fibrillatable polytetrafluoroethylene as differentiated from a fiber made by die-drawing) onto an electrically foraminous substrate, and heating the deposit to dehydrate the asbestos and possibly to temperatures sufficient to fuse the deposit and to shrink the deposit. A product of the present invention, resulting from this process, can accordingly be described as a foraminous electrode coated on its electrically active surface with a porous, fused, coherent, adherent, dimensionally stable deposit of a random mixture of asbestos fibers and polytetrafluoroethylene fibrids. The fused deposit contains polytetrafluoroethylene fibrids in an amount of at least 5 percent by weight and up to about 25 percent by weight, based on the weight of the fused deposit. The fused deposit may contain other fibers and fibrids, in addition to those specified; for example, the fused deposit may also contain conventional polytetrafluoroethylene fibers, made by die-drawing.

The random mixture of asbestos fibers and polytetrafluoroethylene fibrids can be prepared by first forming the polytetrafluoroethylene fibrids and then admixing the fibrids with the asbestos fibers. Polytetrafluoroethylene fibrid formation involves subjecting particulate polytetrafluoroethylene to shear conditions. The particle diameters of the particulate polytetrafluoroethylene may range from about 0.01, microns or less, to about 50, preferably between about 0.1 microns to about 0.5 microns. The particulate polytetrafluoroethylene can be either in the form of a wet (water) dispersion or dry powder. The concentration of polytetrafluoroethylene in a water dispersion should be a concentration sufficiently high to facilitate fibrid formation as polytetrafluoroethylene fibrid initiation becomes difficult at extremely low concentrations; but the concentration must be low enough to obviate large clump formation. By way of example, it is noted that PTFE fibrid formation has been induced in aqueous dispersions containing as low as 1 percent by weight particulate polytetrafluoroethylene to concentrations of about 30 percent by weight.

Certain commercially available products contain particulate polytetrafluoroethylene particles having diameters ranging up to about 0.5 microns required for the production of fibrids. For example, both Fluon CD1, sold by Imperial Chemical Industries Ltd., and Teflon 30B, sold by E. I. DuPont deNemours & Co., have been found to be quite suitable; both contain about 60 percent solids in a water dispersion, including about 6 percent wetting agents, based on the weight of solids. These dispersions are described in U.S. Pat. No. 4,047,537, which is incorporated herein by reference. These dispersions are hydrophilic, negatively charged colloid dispersions, containing particles having diameters preferably of about 0.05 microns to about 0.5 microns, suspended in water. Another commercially available product, Teflon type T-6 (also sold by duPont) can also be used to form the fibrids of the invention; it is a powder agglomerate produced from Teflon 30B. The primary diameters of particles of polytetrafluoroethylene in the duPont Teflon 30B and T-6 dispersions average from about 0.2 microns to about 0.5 microns, while powder agglomerates of the T-6 powder average about 500 microns.

Formation of the polytetrafluoroethylene fibrids is effected by suspending a particulate fibrid inducing substrate in a mass or dispersion of particulate polytetrafluoroethylene and subjecting the polytetrafluoroethylene particles to shearing forces to form fibrids of polytetrafluoroethylene. The fibrid inducing substrate comprises coarse particles of suitable materials. The materials used as the fibrid inducing substrate are substantially physically and chemically inert to the particulate polytetrafluoroethylene. By physically and chemically inert, it is meant that the substrate material will not absorb the polytetrafluoroethylene dispersion and will not chemically react with the polytetrafluoroethylene. The materials used as the fibrid inducing substrate include any solid granular inert material which is easily separated from the fibrids. Suitable fibrid inducing substrate materials include alumina, limestone, salt, sugar, sand and graphite. Preferably salt that is pulverized sodium chloride, is used. Coarse particles of suitable materials may be illustrated by noting that the diameters of particles of particulate alumina, when used as the fibrid inducing substrate, usually range from about 1 microns to about 800 microns, and preferably from about 100 microns to about 200 microns.

Asbestos fibers are admixed with the polytetrafluoroethylene fibrids after fibrid formation. These asbestos fibers may be any product used to form conventional asbestos mat diaphragms. Generally, in the experiments reported below, asbestos fibers of standard length combination which can be used in accordance with the invention comprises two parts short asbestos fibers to one part long asbestos fibers. For example, a mixture of VAG #2 short fibers having lengths ranging from 1/32 inch to 1 inch with an average length of ¼ inch and of VAG #1 long fibers having an average length of ½ inch may be employed. Asbestos fibers are not generally used as the fibrid inducing substrate.

Shearing conditions which affect fibrid formation include the time, the temperature and the shearing force applied to the mixture of particulate polytetrafluoroethylene and substrate. The temperature of the shearing step is a temperature sufficient to render the polytetrafluoroethylene sufficiently plastic to form fibrids. The time duration of the shearing action is temperature dependent, and thus the polytetrafluoroethylene will be maintained at the temperature of the shearing step for time sufficient to allow substantial fibrid formation. The temperature during the shearing step may range from about 20° C. up to about 250° C., preferably from about 60° C. to about 200° C. Most preferably, the polytetrafluoroethylene is heated to a temperature of from about 75° C. to about 100° C. during the shearing step.

The shearing action used to form the polytetrafluoroethylene fibrids is generally a compressive shearing action obtained by mulling or stirring. Various means may be employed to effect a compressive shearing action, including a spatula and beaker, a mortar and pestle, ribbon blade, a small ball mill, a double screw blender and a Banbury mixer or a Hobart mixer. The result of the shearing action is the production of fibrids which may be highly branched or singular fibers or a mixture of both. These fibrids are composed of polytetrafluoroethylene particles having diameters of from about 0.1 microns, or less, up to about 100 microns. The lengths of the fibrids is not critical; the fibrids of experiments reported below are generally less than about one-half inch.

After polytetrafluoroethylene fibrid formation, a random mixture of the polytetrafluoroethylene fibrids and the asbestos fibers is deposited on the foraminous electrically conductive substrate. This has been done by forming an aqueous slurry of the polytetrafluoroethylene fibrids and asbestos fibers in water, in cell liquor, in caustic, in a salt solution or in admixtures thereof. The polytetrafluoroethylene fibrid content of the slurry can be quite variable ranging from about 1 to about 10 grams per liter of slurry volume. The slurry is applied to the foraminous substrate by gravity feed and/or by vacuum applied downstream from the site of deposit. For example, the foraminous electrically conductive substrate can be disposed in a vacuum filtration funnel; vacuum facilitates removal of water from the deposit and matting of the deposit. Thereafter the mat is dried.

The electrically conductive foraminous substrate is a metal mesh or a metal alloy mesh. In other words, the substrate is a mesh electrode. The mesh sizes of the substrate are not critical. Below, a 6-mesh electrode or perforated screen, specifically a mesh cathode, is described in the examples. However, chemically stable metallic mesh electrodes having in excess of 8 mesh to the linear inch and width openings of less than 0.06 inch have been used in chlor-alkali cells. In the embodiment of the invention which is directed to chlor-alkali cells equipped with diaphragms of the invention, the foraminous substrate may be any cathode currently used in chlor-alkali cells. For example, mesh cathodes, wire cathodes, or Ryerson cathodes (perforated steel plate) may be used.

After drying the PTFE fibrid-asbestos fiber deposit at a temperature of about 100° C., it is heated to a temperature in excess of about 290° C. up to a temperature of about 400° C. The exact mechanism by which the present invention results in a long lasting cheaper diaphragm is not known with certainty, but most likely is a combination of the following:

(1) the general mix or tangled nature of the PTFE fibrids and asbestos fibers themselves tend to result in a more stable diaphragm, which is further improved by a shrinking of the PTFE fibrids due to thermal memory or the like by heating above about 290° C. so as to pull the asbestos fibers closer together to form a more compact, stable diaphragm, and/or (2) the heating of the PTFE fibrids above 327°±10° C. probably softens the PTFE fibrids so that they attach to the other PTFE fibrids they are in contact with and/or to the asbestos fibers they are in contact with so as to yield a reinforced network which increases the diaphragm stability.

As stated above the heating must be above about 290° and may extend as high as 400° C. Although temperatures as high as 400° C. can be utilized with appropriate shortening of the heating time, temperatures above 380° C. should be avoided as thermal degradation of the polytetrafluoroethylene starts at about this temperature and interferes to a degree with the effectiveness of the process.

Preferably, the PTFE fibrid-asbestos fiber deposit is heated above the fusion or transition temperature of the PTFE, i.e. 327°±10° C. At these more elevated temperatures, it is possible to use a lesser amount of PTFE fibrids to obtain equivalent results due to the additional attachments formed between the fibrids themselves and/or the fibrids and the asbestos fibers. Most preferably, this heating step is between about 340° C. and about 370° C.

As a result of the heating above 290° C. or fusion point, the polytetrafluoroethylene fibrids form a reticulate or matrix configuration and shrink. The network or matrix acts to hold in or enclose asbestos fibers for improved dimensional stability. As a result of shrinkage during fusion, the diaphragm is made more porous. The increased porosity of the diaphragm so produced reduces the electrical resistance in an operating cell and results in consequent power savings.

The following examples are presented to illustrate the invention and specific embodiments by which the invention can be effected.

EXAMPLE I

To demonstrate the suitable need for fibrid inducing substrate, $CaCO_3$ powder (Fisher 2–20 microns) was used in the following manner: To 98 parts by weight of the $CaCO_3$ was added 3.3 parts by weight of a 60% solids PTFE dispersion (Teflon 30B). Shearing was applied by mulling in a mortar and pestle at 80° C. for 10 min. The $CaCO_3$ was then removed from the mixture by leaching with dilute HCl, and the resulting fibrid residue was washed and then dried at 100° C. for 1 hour to yield about 2.0 parts of Teflon fibrids.

The slurry used for deposition of the diaphragm consisted of the following components:

3.6 g fibrids made as above
9.6 g #2 VAG Short Asbestos fibers
4.8 g #1 VAG Long Asbestos fibers
0.1 g of NOPCO PE 260, a non-ionic dispersant, all in 1 liter of cell liquor (11% NaOH and 16% NaCl solution).

All the above were then stirred vigorously with a dispersator at moderate speeds for about 5 minutes.

The diaphragm is constructed by taking an aliquot portion, approximately 360 milliliters, and passing it by gravity over a 6 mesh cathode (0.093" steel wire calendered to a thickness of 0.155") centered in a 450 ml filtration funnel. A vacuum is applied to the suction flask ranging from 0–2.5" of mercury for about 5 minutes and gradually increased over a five minute interval to 17" Hg vacuum and then holding for drying the deposited diaphragm for a period of 10 minutes. The diaphragm was next heated to 100° C. for one hour for additional drying, and fused at 350° C. for one hour. The resulting mat had a density of 1.25 g/sq inch and contained 20% by weight of PTFE fibrids.

When this 3 sq inch assembly of diaphragm and cathode is installed in a laboratory chlor-alkali cell, it demonstrated good dimensional stability with a very good brine head and permeability (as judged by the flow rate through the diaphragm of 0.185 mls/min/sq inch). Voltage was measured and found to be excellent at 2.98 volts at one asi. These results should be compared with an asbestos diaphragm made in a conventional way but containing no fibrids, in which the diaphragm showed instability, lasting less than 2 days at 3.23 volts (see Table 1). Compare also with a diaphragm made with 25% of Teflon fibers (6.6 denier) with the asbestos fibers, all other conditions being the same; stability and voltage are about the same, showing an equivalency of performance using Teflon fibers and 20% PTFE fibrids. See Table 1 for other examples.

EXAMPLE 2

To demonstrate the use of another fibrid inducing substrate, 98 parts of granular NaCL (approx. 50 mesh) were added to 3.3 parts of a 60% Teflon 30B dispersion. Fibrids were formed by mulling in a mortar and pestle for 30 minutes at 21° C., followed by continuous mulling at 130° C. for 3 minutes. The salt substrate was removed by leaching with water, washed and dried as above. A diaphragm was formed in the same manner as above. It was dried and fused as above. The resulting diaphragm had a mat density of 1.17 g/sq inch and contained 15% by weight of fibrids. It had good performance parameters as set forth in Table 1.

EXAMPLE 3

To demonstrate the use of other equipment to form fibrids, a power muller was used. A 2 wheel Cincinnati brand muller was used, with 1½" wide 8" diameter wheels in a 12" pan. Fibrids were made with a granular salt substrate at 21° C. for 40 minutes, with a 1 kilogram mass on the wheels, using about a 1 kilogram charge. The fibrids were recovered in the same manner as described above and a diaphragm made in exactly the same manner as above, including the drying and fusing. The resulting diaphragm had a density of 1.22 g/sq inch and contained 15% fibrids by weight. The diaphragm performance was comparable to Examples 1 and 2, as set forth in Table 1.

EXAMPLE 4

Exactly the same procedure as in Example 3 was repeated, except that the mass was dried before mulling. This yielded a diaphragm with very similar parameters as above with a mat density of 1.17 and contained 15% by weight fibrids.

TABLE 1

A COMPARISON OF ASBESTOS DIAPHRAGMS MODIFIED BY THE ADDITION OF FIBRIDS IN CHLOR-ALKALI PERFORMANCE

| EXAM. NO. | PERCENT FIBRIDS | SUBSTRATE | BRINE HEAD (INCHES) | VOLTS 1 asi | NaOH g/l | CURRENT EFF. % | STABILITY | DAYS ON LINE |
|---|---|---|---|---|---|---|---|---|
| 1 | 20 | $CaCO_3$ | 3 | 2.98 | 124 | 92 | Stable | 14 |
| 2 | 15 | NaCl | 3¼ | 3.04 | 128 | 92 | Stable | 29 |
| 3 | 15 | NaCl | 5½ | 3.03 | 128 | 93 | Stable | 61 |
| 4 | 15 | NaCl | 6¼ | 3.02 | 131 | 92 | Stable | 52 |
| * | 25 | — | 2½ | 2.98 | 130 | 93 | Stable | 20 |
| ** | None | — | 3½ | 3.23 | 130 | 93 | Stable | 2 |

Notes:
*25% Teflon fibers, 6.6 denier, all conditions standard as per Example 1.
**No fiber or fibrid binder, made in the conventional manner.

EXAMPLES 5 THROUGH 10

The diaphragms of the following examples were used using fibrids made from duPont Teflon T-6 (the solid agglomerate particles made by evaporation of Teflon 30B dispersion) and duPont Teflon 30B (dispersion of PTFE particles). The performance results of these 5 diaphragms are set forth in Table 2.

EXAMPLE 5

Fibrids were made by using 2% Teflon solids from Teflon K-20 (6.6 g of a 30% Teflon solids dispersion) with 98% granular salt, heating to 130° C. for one-half hour and then mulling the wet mix with a spatula in the beaker for about 3 minutes to induce fibrid formation. Fibrids were recovered by leaching out the salt with water, washing and drying. The slurry mix was made by the formula of Example 1, sheared by disperator action for 3 minutes and a diaphragm was deposited as before. The diaphragm was dried and fused as above. The resulting diaphragm had a density of 1.00 g/sq inch and contained 15% fibrids. Performance parameters were similar to those described above.

EXAMPLE 6

In this experiment, Teflon type T-6 particulate PTFE powder was used. Twenty-five parts of Teflon type T-6 and 75 parts of granular salt were added to a mortar. The mix was mulled with a pestle for 60 minutes at 21° C. The fibrids were recovered by leaching out the salt; the fibrids were then washed and dried.

Asbestos, the fibrids made above, Teflon 6.6 denier fibers, and a small quantity of dispersant were added to cell liquor. The resulting diaphragm, made in the manner previously described, was dried and fused at 350° C. for one hour. The resulting diaphragm had 7% fibrids, and 15% Teflon fibers with a mat density of 1.15 g/sq inch. When installed in a chlor-alkali cell, the voltage, concentration and current efficiency all showed superior characteristics as set forth in Table 2.

EXAMPLE 7

In this experiment the use of a ball mill and mulling was demonstrated. Eight parts of Teflon 30B (a 60% solids dispersion) and 92 parts of granular salt, were ball-milled for 2 hours at 21° C. and removed. The mixture was then preheated in an oven to 130° C. and mulled for 5 minutes to form the completed fibrids. The fibrids were recovered and diaphragms were made in the manner described above. The resulting diaphragm had a density of 1.21 and contained 20% fibrids. The superior operating parameters obtained as set forth in Table 2.

EXAMPLE 8

This experiment illustrates the use of both shearing equipment as well as the use of particulate Teflon type T-6. An automated power mortar and pestle were added 5 parts of Teflon T-6 and 95 parts of granular salt, and mulled for 40 minutes at 21° C. The recovered fibrids were admixed with asbestos and Teflon 6.6 denier fibers as described above. The resulting diaphragm made in the manner described above had a density of 1.22 g/sq inch and contained 7% fibrids and 15% Teflon fibers. The superior operating parameters obtained are set forth in Table 2.

EXAMPLE 9

This experiment further demonstrates the use of a power muller, such as the automated mortar and pestle to make fibrids from Teflon type T-6. Two parts T-6 and 98 parts of granular salt were placed in a power mortar and pestle. This mixture was mulled at room temperature for 40 minutes and then at 85° C. for 1 minute. The resulting fibrids were made into a diaphragm with asbestos fibers in the manner described above and had a density of 1.15 g/sq inch and contained 15% fibrids. The superior operating parameters obtained are set forth in Table 2.

EXAMPLE 10

The procedure of Example 9 was repeated except that the density was increased a little at 1.22 g/sq inch. The superior operating parameters obtained are set forth in Table 2.

TABLE 2

COMPARISON OF ASBESTOS DIAPHRAGMS MODIFIED BY THE ADDITION OF FIBRIDS AND TEFLON FIBERS MADE IN VARIOUS DIFFERENT WAYS IN CHLOR-ALKALI CELL PERFORMANCE

| EXAM. NO. | PERCENT FIBRIDS | SUBSTRATE | BRINE HEAD (INCHES) | VOLTS 1 asi* | NaOH g/l | CURRENT EFF. % | STABILITY | DAYS ON LINE |
|---|---|---|---|---|---|---|---|---|
| 5 | 15 | NaCl | 1½ | 3.01 | 129 | 91 | Stable | 29 |
| 6 | 7% + 15% fibers | NaCl | 2¼ | 3.02 | 129 | 93 | Stable | 13 |

TABLE 2-continued

COMPARISON OF ASBESTOS DIAPHRAGMS MODIFIED BY THE ADDITION OF FIBRIDS AND TEFLON FIBERS MADE IN VARIOUS DIFFERENT WAYS IN CHLOR-ALKALI CELL PERFORMANCE

| EXAM. NO. | PERCENT FIBRIDS | SUBSTRATE | BRINE HEAD (INCHES) | VOLTS 1 asi* | NaOH g/l | CURRENT EFF. % | STABILITY | DAYS ON LINE |
|---|---|---|---|---|---|---|---|---|
| 7 | 20 | NaCl | 4½ | 3.05 | 130 | 94 | Stable | 51 |
| 8 | 7% + 15% fibers | NaCl | 3½ | 3.06 | 131 | 93 | Stable | 60 |
| 9 | 15 | NaCl | 4½ | 3.09 | 130 | 94 | Stable | 91 |
| 10 | 15 | NaCl | 4 | 3.03 | 131 | 94 | Stable | 100 |

*amperes per square inch

The following examples show the processing of fibrids by pilot plant scale equipment.

EXAMPLE 11

3.59 pounds of salt were pulverized to 100 mesh by a hammermill, added to 0.24 pound of a Teflon type 30B dispersion (60% Teflon solids dispersion) and mixed dry. This is a 4% Teflon fibrid blend. The mixture was then compression sheared in a 4 pound Banbury brand mixer for 13 minutes with a partial ram pressure. The resulting fibrids were recovered in the usual manner, washed and dried, and diaphragms prepared in the same manner as in Example 1, from an approximately 18 grams/liter slurry from cell liquor, again in the usual manner. The density of the diaphragm was 1.30 g/sq inch with a fibrid content of 15%. The superior operating parameters obtained in a chlor-alkali cell are set forth in Table 3.

EXAMPLE 12

This is another example of pilot scale fibrid production. A 5% blend of Teflon 30B solids (from a 60% Teflon solids dispersion) of 100 mesh salt was processed in a Banbury brand mixer for 9 minutes as above with partial ram pressure. The fibrids, recovered in the usual manner, were added to the cell liquor with asbestos fiber and air/vacuum agitated for 1 hour. The resulting diaphragm had a density of 1.25 g/sq inch and a fibrid content of 15%. The superior operating parameters obtained in a chlor-alkali cell are set forth in Table 3.

EXAMPLE 13

This experiment illustrates a variation in the processing of fibrids. Teflon 30B was premixed with 100 mesh salt, as an 8% blend, in a ribbon blender at 80°–90° C. for 30 minutes. No Banbury mixer was used. The diaphragm was made in the manner described above and contained 20% of the fibrids as recovered from the ribbon blender. The superior operating parameters obtained in a chlor-alkali cell are set forth in Table 3.

EXAMPLE 14

This experiment again is a variation in processing equipment and conditions. Teflon 30B was premixed with 100 mesh salt, as a 4% blend, in a 1 cu. ft. ribbon blender at 80°–90° C. for 45 minutes. It was compression sheared in a Banbury mixer for 13 minutes as described in Example 11. The fibrids salt mixture was dissolved in water, and the major portion of the salt water was removed to yield a saline slurry containing about 8.8 grams/liter of fibrids. About 250 mls of this slurry (2.2 g of fibrids) was added to 500 mls of water, 250 mls of standard cell liquor, 15.8 g of asbestos fibers and mechanically sheared by a dispersator. A stable diaphragm was made from this slurry in the usual manner and had a density of 1.20 g/l with 12% fibrids. Its performance in a chlor-alkali cell was augmented by using approximately half the normal gap between electrodes as well as the use of a porous nickel-coated steel cathode to yield an unusually low voltage (2.64 volts vs. a normal 3.00 volts—1 asi).

TABLE 3

A COMPARISON AS ASBESTOS DIAPHRAGM MODIFIED WITH THE ADDITION OF FIBRIDS MADE ON A PILOT PLANT SCALE ON A SALT SUBSTRATE ON PERFORMANCE IN A CHLOR-ALKALI CELL

| EXAM. NO. | PERCENT FIBRIDS | BRINE HEAD (INCHES) | VOLTS 1 asi | NaOH g/l | CURRENT EFFICIENCY | DAYS ON LINE | POWER KWHr/ST $Cl_2$* | NOTES |
|---|---|---|---|---|---|---|---|---|
| 11 | 15 | 4 | 2.98 | 129 | 95% | 59 | 2160 | Stable |
| 12 | 15 | 4 | 2.99 | 129 | 94 | 70 | 2190 | Stable |
| 13 | 20 | 2½ | 3.01 | 130 | 93 | 104 | 2120 | Stable |
| 14 | 12 | 4 | 2.64 | 130 | 92 | 17 | 1980 | Stable; ¼" gap porous Ni cathode |

*Per short ton of chlorine

Thus it is apparent that there has been provided, in accordance with the invention, a diaphragm coated foraminous electrode that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A process for making polytetrafluoroethylene fibrid and asbestos fiber containing diaphragm for an electrolytic cell, comprising:

forming an aqueous slurry of asbestos fibers and polytetrafluoroethylene fibrids, wherein said polytetrafluoroethylene fibrids comprise from about 1 to about 10 grams/liter of said slurry, and wherein said polytetrafluoroethylene fibrids before shrinking are between about 0.1 microns to 100 microns in diameter, by dissolving a solid, granular, inert material intimately admixed with polytetrafluoroethylene fibrids and mixing same with asbestos fiber, said dissolving occurring before or after said mixing;

depositing said slurry of asbestos fibers and polytetrafluoroethylene fibrids on a foraminous electrically conductive substrate to form a mat for a diaphragm while removing the majority of the dissolved solid, granular, inert material; and heating said deposited slurry to dry said mat, and thereafter heating said dry mat to temperatures about 290° C., to shrink and/or fuse said polytetrafluoroethylene fibrids in said dried mat to form a matrix holding said asbestos fibers in a polytetrafluoroethylene fibrid and asbestos fiber containing diaphragm, said fused deposit containing polytetrafluoroethylene fibrids comprising from about 5 to about 25 percent by weight of said diaphragm.

2. The process of claim 1, wherein said heating of said dry mat is at temperatures between the fusion temperature of the polytetrafluoroethylene fibers (327° C.±10° C.) and 370° C.

3. The process as stated in claim 2, wherein said heating of said dry mat is conducted at temperatures between about 340° C. and about 370° C.

4. A process for making a polytetrafluoroethylene fibrid and asbestos fiber containing diaphragm for an electrolytic cell, comprising:

forming said polytetrafluoroethylene fibrids by suspending particulate polytetrafluoroethylene in a fibrid inducing substrate, wherein said fibrid inducing substrate comprises a solid, granular, inert material which is easily separated from polytetrafluoroethylene fibrids, and subjecting said suspension to a compressive shearing action at a temperature between about 20° C. and about 250° C.;

forming an aqueous slurry of asbestos fibers and polytetrafluoroethylene fibrids in said fibrid inducing substrate and dissolving said fibrid inducing substrate;

depositing said slurry of asbestos fibers and polytetrafluoroethylene fibrids on a foraminous electrically conductive substrate to form a mat for a diaphragm while removing most of said dissolved fibrid inducing substrate; and heating said deposited slurry to dry said mat, and thereafter heating said dry mat to temperatures above about 290° C., to shrink and/or fuse said polytetrafluoroethylene fibrids in said dried mat to form a matrix holding said asbestos fibers in a polytetrafluoroethylene fibrid and asbestos fiber containing diaphragm.

5. The process of claim 4, wherein said heating of said dry mat is at temperatures between the fusion temperature of the polytetrafluoroethylene fibers (327° C.±10° C.) and 370° C.

6. The process set forth in claim 5, wherein said compressive shearing action takes place at a temperature between about 75° C. and about 100° C.

7. The process as stated in any of claims 4, 5, or 6, wherein said heating of said dry mat is conducted at temperatures between about 340° C. and about 370° C.

8. A diaphragm for an electrolytic cell containing polytetrafluoroethylene fibrids and asbestos fibers made by the process of claims 1 or 4.

* * * * *